US006338655B1

(12) United States Patent
Masse et al.

(10) Patent No.: US 6,338,655 B1
(45) Date of Patent: Jan. 15, 2002

(54) LOW-VOLTAGE CONNECTOR PROVIDED WITH AN ADAPTER, AND AN ADAPTER FOR SUCH A CONNECTOR

(75) Inventors: Dominique Masse, Epinay sur Orge; Jacques Nozick, Paris, both of (FR)

(73) Assignee: Infra +, L'Hay les Rose (FR)

( * ) Notice: Subject to any disclaimer, the term of this patent is extended or adjusted under 35 U.S.C. 154(b) by 0 days.

(21) Appl. No.: 09/527,574

(22) Filed: Mar. 16, 2000

(30) Foreign Application Priority Data

Mar. 16, 1999 (FR) ..... 99 03199

(51) Int. Cl.[7] ..... H01R 4/24
(52) U.S. Cl. ..... 439/638; 439/676
(58) Field of Search ..... 439/628, 638, 439/443, 676, 76.1

(56) References Cited

U.S. PATENT DOCUMENTS 4,943,248 A * 7/1990 Colleran et al. ..... 439/850
5,178,558 A * 1/1993 Knox et al. ..... 439/638 X
5,951,330 A * 9/1999 Reichard, Jr. et al. ..... 439/676

FOREIGN PATENT DOCUMENTS

GB 2 231 210 11/1990
GB 2 305 025 3/1997

* cited by examiner

*Primary Examiner*—Renee Luebke
(74) *Attorney, Agent, or Firm*—Sughrue Mion, PLLC

(57) ABSTRACT

A low-voltage connector provided with a plurality of pins arranged in pairs, each pin being provided with a contact zone at the front of the connector, which contact zone serves to come into electrical contact when an associated connector is plugged in, and with a connection zone at the rear of the connector, which connection zone normally serves to establish electrical connection with a respective conductor wire, an adapter provided with connection means co-operating, instead of said conductor wires, with the connection zones of the pins and with contact means serving to come into electrical contact with a separate component, wherein said connection zones comprise insulation-displacement contacts provided with slots, and the connection means of the adapter comprise pins inserted into the slots of the insulation-displacement contacts.

8 Claims, 4 Drawing Sheets

LOW-VOLTAGE CONNECTOR PROVIDED WITH AN ADAPTER, AND AN ADAPTER FOR SUCH A CONNECTOR

The present invention relates to a low-voltage connector, and more particularly to a low-voltage connector that belongs to a specific category referred to as"category 7" having low crosstalk levels because of the isolation of the pins arranged in pairs.

BACKGROUND OF THE INVENTION

That type of low-voltage connector comprises a generally metal or metal-plated body defining electromagnetically-isolated compartments in which the pins of the connector are disposed in pairs so that there is almost no inductive coupling between the various pairs of pins. It is thus a type of low-voltage connector that is particularly suitable for high data rates, unlike a connector of the RJ 45 type which has much lower-performance crosstalk characteristics.

The pins arranged in pairs inside the metal or metal-plated body are held in a bed of plastics material. Each pin has a contact zone serving to come into electrical contact with the pins of another connector of the same type, and a connection zone that normally serves to receive a conductor wire of a pair that is part of an eight-wire cord. In general, the connection means are in the form of insulation-displacement contacts that define respective slots into which the individual conductor wires are inserted so as to cut through their protective coverings to their cores.

As indicated above, such a low-voltage connector may be associated with another connector of the same type: this is possible because of the hermaphrodite nature of that type of low-voltage connector.

To sum up, it can be said that the rear portion of the connector that has the insulation-displacement contacts serves for wiring a cord having four pairs of conductor wires, while the front portion serves for enabling another connector of the same type to be plugged into it.

That particular type of low-voltage connector (category 7) can be used in distribution cabinets, e.g. incorporated in rack front panels, or else inside an electronic appliance, mounted on a printed circuit. However, the connector to be mounted in a rack front panel and the connector to be mounted in an electronic appliance on a printed circuit are not of exactly the same type, and they require special tools which give rise to additional cost. Special tools are necessary for connecting the connection cables to a connector installed in a rack front panel, and other special tools are necessary for mounting a connector on a printed circuit.

In addition, it is not possible to use an RJ 45 connector or a coaxial connector to connect up to that end of the connector which has the insulation-displacement contacts. That end is specially suited to receiving the pairs of wires from a wiring cord and not to receiving a connector of a totally different type.

OBJECTS AND SUMMARY OF THE INVENTION

An object of the present invention is to mitigate those drawbacks of the prior art by defining a low-voltage connector making it possible to connect another type of connector (RJ 45, BNC, or some other type) to its rear portion, or to mount the connector directly on a printed circuit board.

To this end, the present invention provides a low-voltage connector provided with a plurality of pins arranged in pairs, each pin being provided with a contact zone at the front of the connector, which contact zone serves to come into electrical contact when an associated connector is plugged in, and with a connection zone at the rear of the connector, which connection zone normally serves to establish electrical connection with a respective conductor wire, an adapter provided with connection means co-operating, instead of said conductor wires, with the connection zones of the pins, and also provided with contact means serving to come into electrical contact with a separate component, wherein said connection zones comprise insulation-displacement contacts provided with slots, and the connection means of the adapter comprise pins inserted into the slots of the insulation-displacement contacts.

Advantageously, the insulation-displacement contacts provided with slots are directly accessible from the rear of the connector and are angularly positioned such that the pins are inserted into the slots of the insulation-displacement contacts by a plug-in movement in translation. The adapter is merely plugged into the slots of the insulation-displacement contacts, which is not possible with a plug of the RJ 45 type in which it is necessary to open the plug in order to connect the wires electrically.

When the connector is to be fixed directly to a printed circuit board, the adapter may be provided with tabs that co-operate with contact holes provided in a printed circuit. The printed circuit thus constitutes the separate component so that the connector can be mounted on the printed circuit of an electronic appliance via said adapter.

In another version, the adapter may incorporate a printed circuit portion which then defines contact means serving to come into electrical contact with a connector of the RJ 45 type, of the BNC type, or of some other type.

In which case, each of the pins may be formed with a tab inserted into a respective contact hole provided in a printed circuit defining the contact means.

The present invention also provides an adapter as defined above, advantageously having fixing means for fixing it to said low-voltage connector.

BRIEF DESCRIPTION OF THE DRAWINGS

The present invention is described more fully below with reference to the accompanying drawings which show three non-limiting embodiments of the present invention.

In the drawings.

MORE DETAILED DESCRIPTION

Figure 1A:
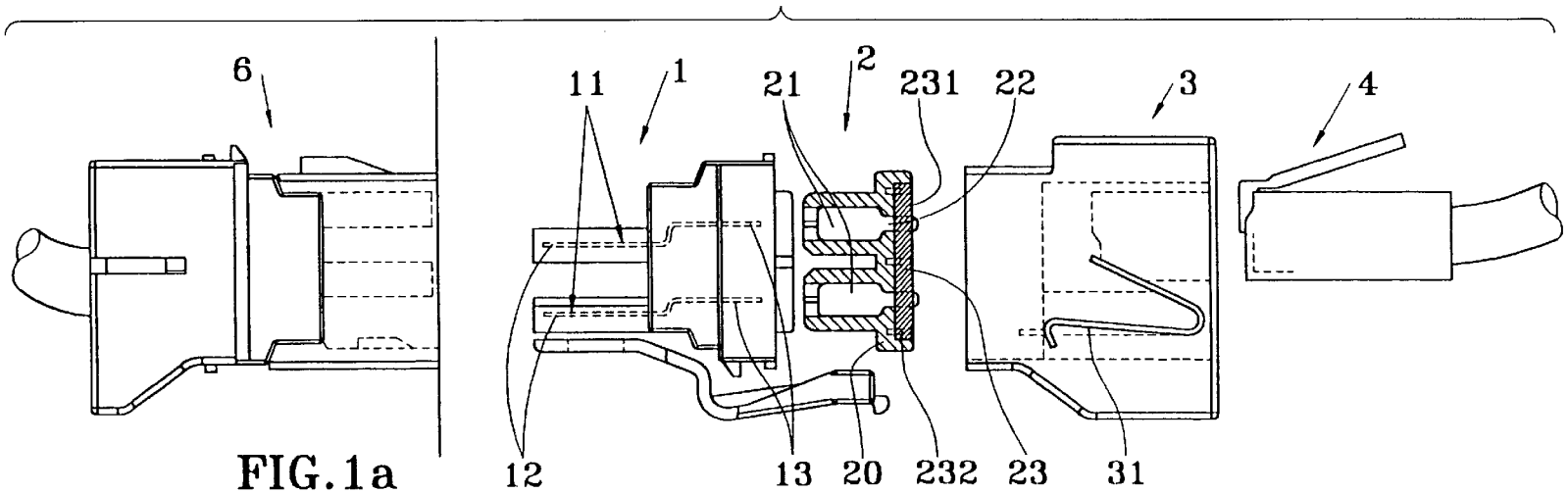
FIG. 1*a* is a diagrammatic exploded section view of a connector of the invention serving to co-operate with a connector of the RJ 45 type.

The low-voltage connector on which the adapter of the invention is mounted is designated overall by the numerical reference 1. As mentioned above, the low-voltage connector is of a particular type comprising a housing 10 which is generally made of metal or metal-plated, and which is subdivided into four compartments, each of which serves to receive a respective pair of pins, which makes a total of eight pins for the connector. Each pair of pins is held in its respective compartment by a bed which is made of a plastics material. This bed is not shown in the drawings. The pins extend through the housing 10 of the connector 1 so as to define an inlet and an outlet of the connector. At the inlet end (clearly visible in FIG. 2), the pins, designated by the numerical references 11, define a connection end portion, e.g. implemented in the form of insulation-displacement contact 13. The insulation-displacement contacts 13 serve to receive pairs of wires from a low-voltage cable (not shown). Each wire of the cable is individually inserted into the slot in its respective insulation-displacement contact so as to cut through its protective covering to its core, thereby defining electrical contact. Normally, the four pairs of conductor wires forming the low-voltage cable are inserted through a piece which serves as a three-dimensional organizer making it possible to bring each individual wire into the slot in its respective insulation-displacement contact. It is then necessary merely to press or push the three-dimensional organizer piece into the connector 1 in order to establish simultaneously the contact between the eight wires and the pins of the connector.

At the outlet end, the connector defines two stages of contacts 15, each of which comprises four pins 11. At this end, the pins define a contact zone serving to come into electrical contact with a connector of the same type. Advantageously, the associated connector may also be a hermaphrodite-type male connector.

To sum up, it can be said that the four pairs of pins 11 are disposed in two planes, each of which contains two pairs defining, at one end, insulation-displacement contacts for conductor wires, and, at the other end, contact zones for an associated connector.

The adapter of the invention, which is designated by the reference numeral 2 in the figures, co-operates with the connector 1 at its inlet end, i.e., the end provided with the insulation-displacement contacts 13, instead of the conductor wires of the low-voltage cable (not shown). The adapter 2 is substantially identical in both of the embodiments shown in FIGS. 1*a*, 1*b*, and 2. In each of the embodiments, the adapter comprises a body 20 that is generally made of a molded plastics material, eight pins 21 disposed in a three-dimensional geometrical configuration that is identical to the configuration of the insulation-displacement contacts 13 of the pins 11 of the connector 1, and a printed circuit board 23. As can be seen in FIG. 2, which is an exploded view, also of the adapter 2, the rear face of the body 20 of the adapter is provided with a recess 202 serving to receive the printed circuit board 23. In addition, the end wall of the recess 202 is provided with eight openings 203. As shown in FIGS. 1*a*, 1*b*, 2*a*, 2*b*, the heads 22 of the pins 21 are of dimensions suitable for passing through the openings 203 provided in the end wall of the recess 202 in the body 20 of the adapter 2. Furthermore, the printed circuit board 23 is also formed with connection holes 231 whose dimensions are suitable for receiving the heads 22 of the pins 21 with a tight fit so that the heads 22 of the pins 21 are held inside the contact holes 231 in the printed circuit board 23 while holding the body 20 between them.

Figure 1B:
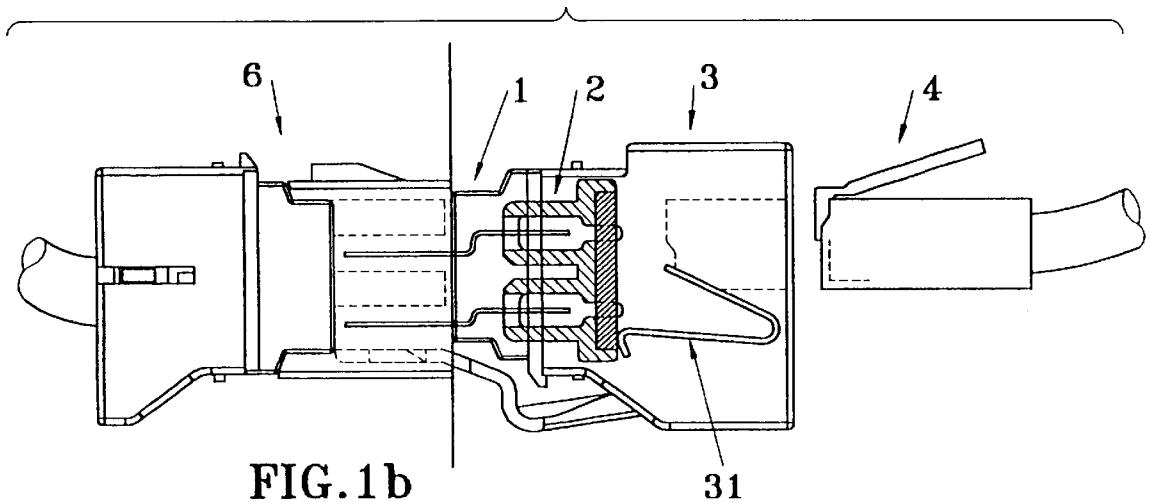
FIG. 1*b* is a view of FIG. 1*a* in the assembled state, with the RJ 45 connector ready to be inserted.
Figure 2:
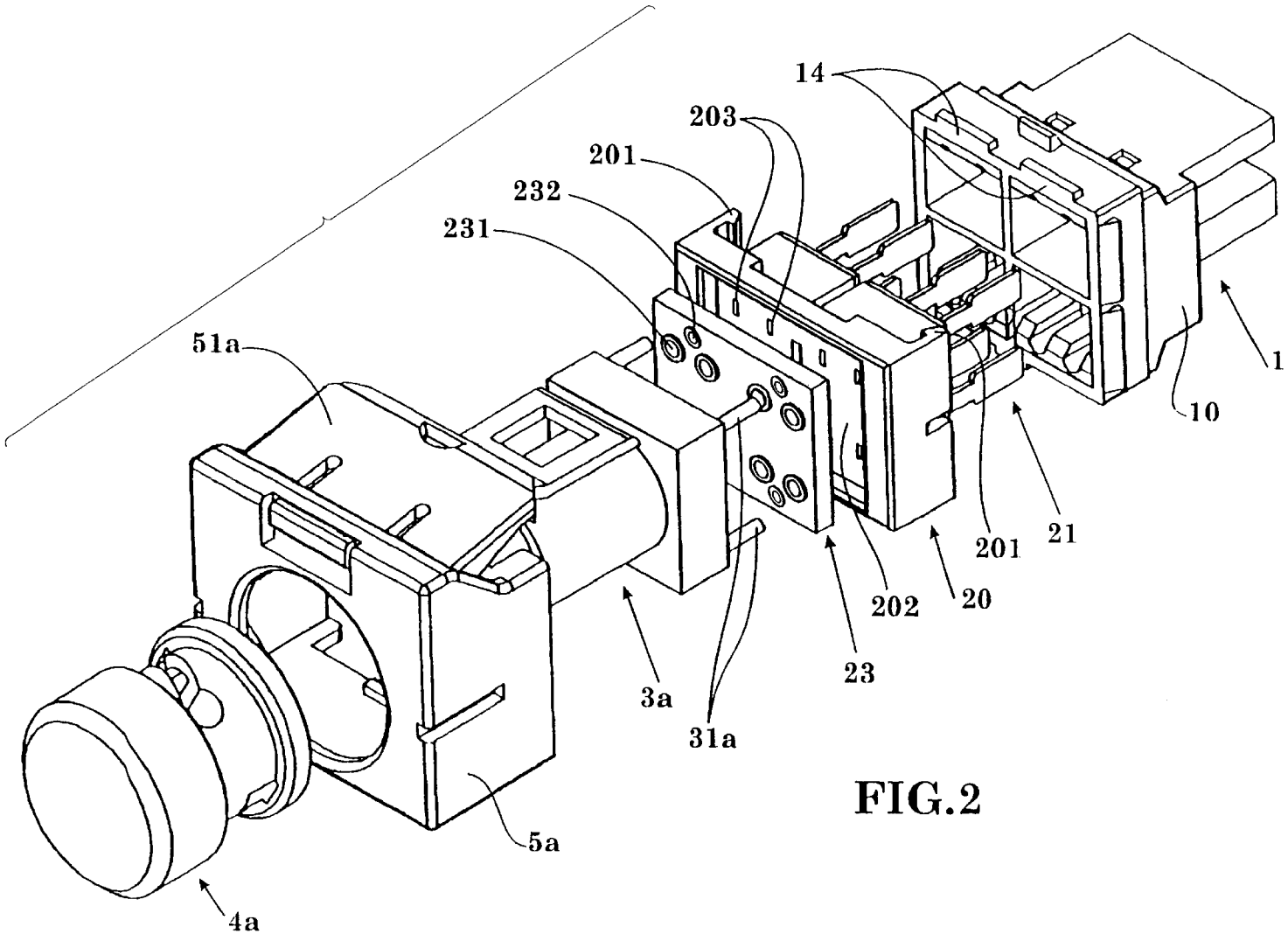
FIG. 2 is an exploded perspective view of a connector of the invention as equipped with an adapter ready to receive a connector of the coaxial type (BNC) or of some other type.

In the first embodiment shown in FIGS. 1*a* and 1*b*, the printed circuit board 23 is provided with eight contact zones (not shown) which connect to respective ones of eight heads 22 of the pins via conductive tracks extending in the printed circuit 23. The eight contact zones (not shown) serve to come into electrical connection with respective ones of eight pins 31 that are part of a female connector 3 of the RJ 45 type. For this purpose, the RJ 45 female connector 3 is provided with means for co-operating with the connector 1 so as to press the ends of the contact pins 31 against the contact zones of the printed circuit 23. It is then possible to plug a male connector 4 of the RJ 45 type into the corresponding recess formed in the RJ 45 female connector 3. Thus, by means of the adapter 2 of the invention, it is possible to connect a male connector 4 of the RJ 45 type to the category 7 low-voltage connector 1 by means of the adapter 2.

The adapter 2 is extremely simple to mount on the connector 1 since the three-dimensional layout of the pins 21 is identical to that of the insulation-displacement contacts 13 of the pins 11 of the connector 1. Thus, merely by plugging the adapter 2 into the connector 1 via the end provided with insulation-displacement contacts, the pins 21 are inserted automatically into the insulation-displacement contacts 13 of the pins 11, thereby establishing the electrical contact (see enlarged detail of FIG. 2*b*). As can be seen in FIG. 2, the adapter 2 may, for example, be fixed to the connector 1 by snap-fastening by means of snap-fastening catches 201 that co-operate with a corresponding profile of the housing 10 of the connector 1.

Figure 2A:
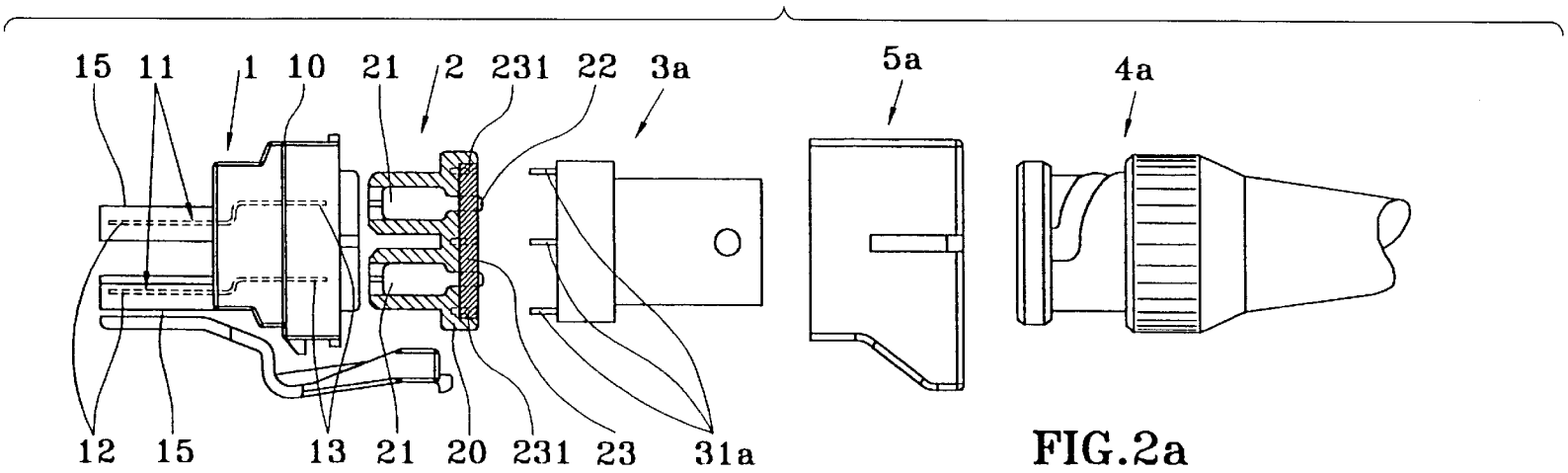
FIGS. 2*a* and 2*b* are views similar to the views in FIGS. 1*a* and 1*b*, for the connector of FIG. 2.
Figure 2B:
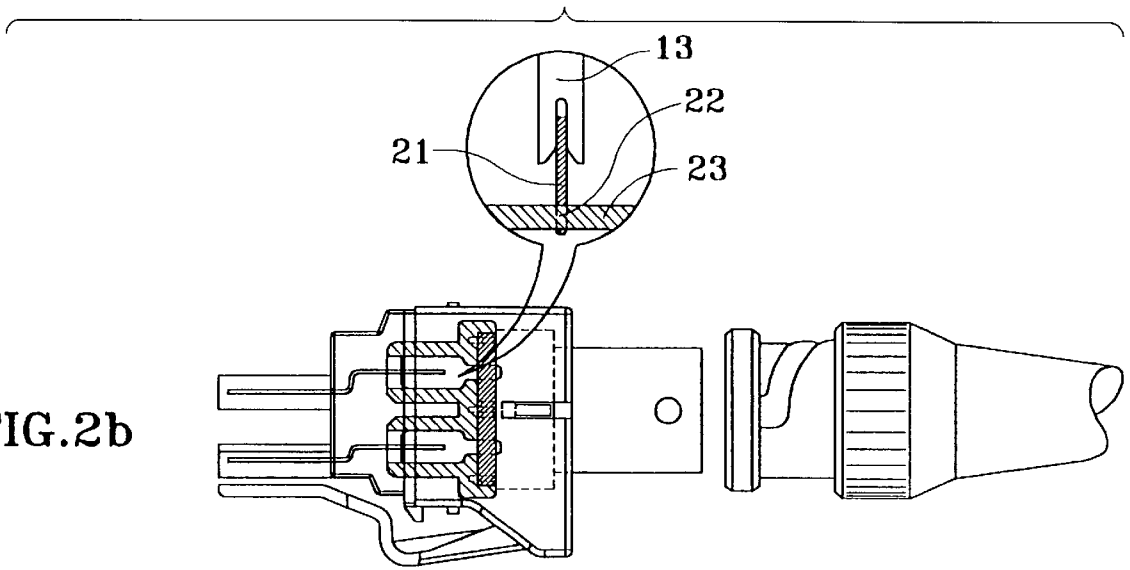

FIGS. 2, 2*a*, and 2*b* show another use for the adapter 2: instead of the RJ 45 female connector 3, a coaxial connector 3*a* of the BNC type or of some other type is used whose contact pins 31*a* are inserted into respective pluggable holes 232 provided in the printed circuit board 23 as clearly visible in FIG. 2. Therefore, the only difference with the adapter of FIGS. 1*a* and 1*b* is the connection mode of the connector because, instead of using contact zones, pluggable holes 232 are used to perform an exactly identical function. To complete the wiring and to protect the connection assembly, a cover 5*a* is installed on the coaxial connector 3*a*, which cover has a tongue 51*a* suitable for co-operating by snap-fastening with snap-fastening catches 14 (FIG. 3*b* and 3*a*) formed on the housing 10 of the connector 1. Finally, it is possible to connect up to the connector 3*a* by means of a female coaxial connector 4*a*.

Thus, by means of the adapter, it is possible to connect a BNC-type coaxial connector to a category-7 connector.

Figure 3A:
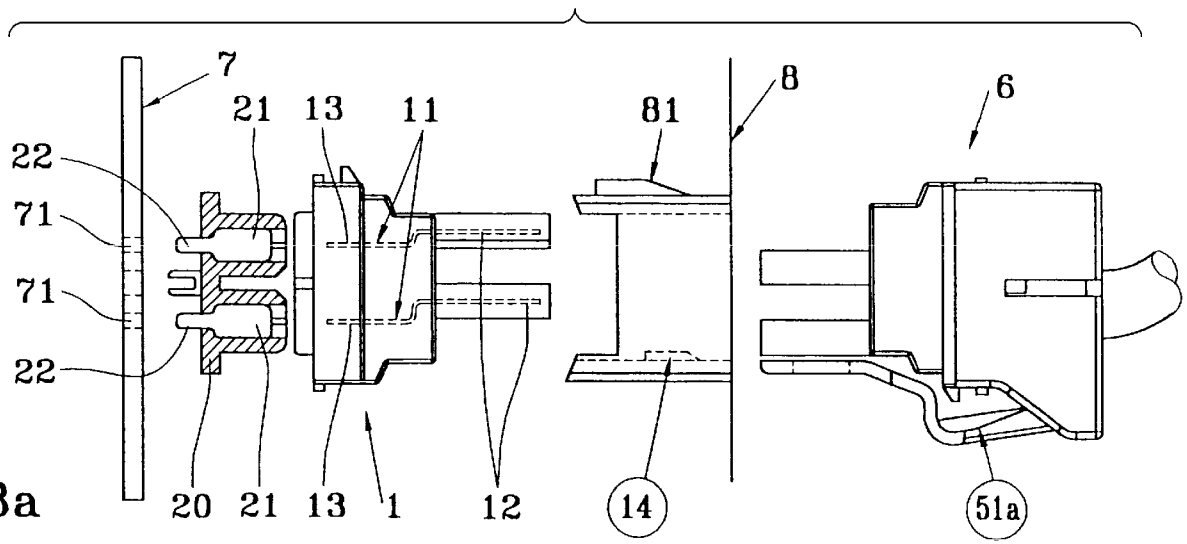
FIGS. 3*a* and 3*b* are views similar to those of FIGS. 1*a* and 1*b* for a connector of the invention serving to be mounted on a printed circuit board, e.g. incorporated in an electronic appliance.
Figure 3B:
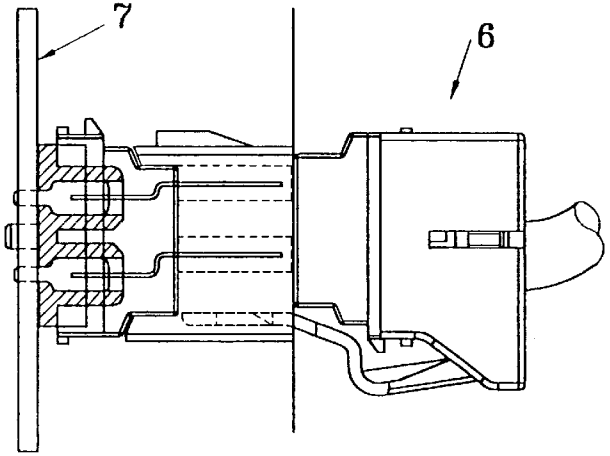

Reference is made below to FIGS. 3*a* and 3*b* which show the third embodiment of the adapter of the invention. In this case, the aim is no longer to be able to connect up to the connector 1 by means of a different type of connector, but rather to mount the connector 1 directly on a printed circuit board, e.g. installed inside any electronic appliance. Substantially the same adapter is used as in the preceding embodiments except that the printed circuit board is an integral part of the electronic appliance on which the connector 1 is to be mounted. For this purpose, as can be seen in FIGS. 3*a* and 3*b*, the adapter comprises merely a body 20 on which eight connection pins 21 are mounted that are provided with plug-in heads 22 serving to be inserted into pluggable holes 71 provided in the printed circuit board 7. The adapter 2 may be fixed to the connector 1 (as in FIG. 2) by a snap-fastening 201 that co-operates with a corresponding profile of the housing 10 of the connector 1. In this version, the connector 1 is fully incorporated inside the electronic appliance, and the contact zones 12 are accessible via a port provided in the wall 8 of the appliance which may advantageously be provided with a support 81 making it possible to hold the connector 1 in position inside the appliance. It is then possible to connect up by means of a connector 6 of the same type and that is advantageously hermaphrodite.

The spirit of the invention lies in the fact that it is possible to connect a low-voltage connector, e.g. a connector of category 7, to a connector of some other category or to a printed circuit board by using an adapter installed in place of the conductor wires of the connection cable, said adapter using a printed circuit board to perform the connection.

What is claimed is:

1. A low-voltage connector comprising:

a plurality of pins arranged in pairs, each pin being provided with a contact zone at a front of the connector, which contact zone serves to come into electrical contact when an associated connector is plugged in, and with a connection zone at a rear of the connector, which connection zone is adapted to establish electrical connection with a respective conductor wire; and an adapter provided with connection means co-operating with the connection zones of the pins, and also provided with contact means serving to come into electrical contact with a separate component;

wherein said connection zones comprise insulation-displacement contacts provided with slots, and the connection means of the adapter comprise pins inserted into the slots of the insulation-displacement contacts; and wherein the adapter is provided with tabs that co-operate with contact holes provided in a printed circuit.

2. A connector according to claim 1, in which the insulation-displacement contacts provided with slots are directly accessible from the rear of the connector and are angularly positioned such that the pins are inserted into the slots of the insulation-displacement contacts by as plug-in movement in translation.

3. A low-voltage connector according to claim 1, in which the printed circuit constitutes the separate component, so that the connector can be mounted on a printed circuit of an appliance via said adapter.

4. A low-voltage connector comprising:

a plurality of pins arranged in pairs, each pin being provided with a contact zone at a front of the connector, which contact zone serves to come into electrical contact when an associated connector is plugged in, and with a connection zone at a rear of the connector, which connection zone is adapted to establish electrical connection with a respective conductor wire; and an adapter provided with connection means co-operating with the connection zones of the pins, and also provided with contact means serving to come into electrical contact with a separate component;

wherein said connection zones comprise insulation-displacement contacts provided with slots, and the connection means of the adapter comprise pins inserted into the slots of the insulation-displacement contacts; and wherein the low-voltage connector further comprises a printed circuit that is an integral part of the adapter.

5. A low-voltage connector comprising:

a plurality of pins arranged in pairs, each pin being provided with a contact zone at a front of the connector, which contact zone serves to come into electrical contact when an associated connector is plugged in, and with a connection zone at a rear of the connector, which connection zone is adapted to establish electrical connection with a respective conductor wire; and an adapter provided with connection means co-operating with the connection zones of the pins, and also provided with contact means serving to come into electrical contact with a separate component;

wherein said connection zones comprise insulation-displacement contacts provided with slots, and the connection means of the adapter comprise pins inserted into the slots of the insulation-displacement contacts; and in which the contact means comprises a printed circuit connected to the connection means.

6. A low-voltage connector according to claim 5, in which the printed circuit is provided with a plurality of contact zones serving to come into electrical contact with a separate connector of a different type.

7. A low-voltage connector comprising:

a plurality of pins arranged in pairs, each pin being provided with a contact zone at a front of the connector, which contact zone serves to come into electrical contact when an associated connector is plugged in, and with a connection zone at a rear of the connector, which connection zone is adapted to establish electrical connection with a respective conductor wire; and an adapter provided with connection means co-operating with the connection zones of the pins, and also provided with contact means serving to come into electrical contact with a separate component;

wherein said connection zones comprise insulation-displacement contacts provided with slots, and the connection means of the adapter comprise pins inserted into the slots of the insulation-displacement contacts; and in which each of the pins of the adapter is formed with a tab inserted into a respective contact hole provided in a printed circuit defining the contact means.

8. A low-voltage connector assembly, comprising:

a connector having a plurality of pins, each pin provided with a contact zone at a front of the connector and with a connection zone at a rear of the connector; and an adapter provided with connection means for co-operating with the connection zones of the pins, and contact means for electrical connecting with a separate component; and wherein the connection zones comprise insulation-displacement contacts provided with slots, and the connection means of the adapter comprise pins inserted into the slots of the insulation-displacement contacts; and wherein the contact means is a printed circuit and the pins of the connection means are connected to the printed circuit.

* * * * *